United States Patent [19]

Campagnuolo et al.

[11] Patent Number: 4,567,828

[45] Date of Patent: Feb. 4, 1986

[54] BOMB SAFETY DEVICE

[75] Inventors: Carl J. Campagnuolo, Potomac, Md.; Clayton L. Tew, Crestview, Fla.

[73] Assignee: The United States of America as represented by the Secretary of the Army, Washington, D.C.

[21] Appl. No.: 589,908

[22] Filed: Mar. 14, 1984

[51] Int. Cl.[4] ..... F42C 15/40

[52] U.S. Cl. ..... 102/208; 102/202.2; 102/220

[58] Field of Search ..... 102/208, 220, 218, 209, 102/202.1, 202.2, 206, 215

[56] References Cited

U.S. PATENT DOCUMENTS

| | | | |
|---|---|---|---|
| 3,393,640 | 7/1968 | Harnau | 102/209 |
| 4,001,610 | 1/1977 | Griffin | 102/218 |
| 4,027,593 | 6/1977 | Campagnuolo et al. | 102/208 |
| 4,031,827 | 6/1977 | Collier | 102/208 |
| 4,201,136 | 5/1980 | Morris | 102/208 |

*Primary Examiner*—Deborah L. Kyle
*Assistant Examiner*—Michael Carone
*Attorney, Agent, or Firm*—Saul Elbaum; Harry Lupuloff; Anthony T. Lane

[57] ABSTRACT

A bomb having an electrical fuze is provided. A charging device is located within the bomb, and a wind driven energizing means is located within the charging device. Means are also provided for causing the energizing means to pop-up out of the charging device so as to expose the energizing means to the wind. A signal is produced when the energizing means pops-up out of the charging device. Power generated by the energizing means is supplied to the fuze only if the energizing means is activated by the wind within a preset time of the signal occuring.

4 Claims, 5 Drawing Figures

BOMB SAFETY DEVICE

RIGHTS OF THE GOVERNMENT

The invention described herein may be manufactured and used by or for the U.S. Government for government purposes without the payment to us of any royalty thereon.

BACKGROUND OF THE INVENTION

This invention relates to bomb safety devices. More particularly, it relates to charging systems that provide energy for electric bomb fuzes and for safety features relating thereto.

Bomb fuze charging systems in current use are installed and designed so that the electric bomb fuzes are energized while falling from the aircraft just after release. Upon release, the charging gear is disengaged and the fuze becomes fully charged and ready for arming. The safety of the bomb is dependent on the reliability of the various safety devices in the fuze to prevent arming until the bomb has actually fallen a safe distance from the aircraft. A malfunction or sabotage of the charging gear occurring, for example, while the plane is still on the ground, or a malfunction when the plane is still carrying the bomb, could lead to a premature detonation causing serious injury to the aircraft and/or the crew members.

An example of a bomb fuze charging system is disclosed in U.S. Pat. No. 4,031,827, incorporated by reference herein, issued on June 28, 1977 to Collier, and entitled "Pop-Up Cover For Slipstream Generator." This patent discloses an airflow actuated power supply and switch device having a pop-up cover which includes an air scoop, a switch actuator mechanism and an interface cable as a part thereof. A potential problem with this device is that sabotage on the ground or mechanical defects could result in the air scoop being installed in the pop-up mode on the aircraft. If this happens the fuze could be prematurely charged after the plane takes off, which could lead to premature detonation of the bomb.

Another example of a bomb fuze charging system is disclosed in U.S. Pat. No. 3,990,370, incorporated by reference herein, issued Nov. 8, 1976 to Campagnuolo et al, and entitled "Safety Device for Bomb Fuse Charging." The patent discloses an environmental charging system for providing energy to electrically fuzed bombs without the need for external charging equipment. The system comprises an electrically fuzed bomb having a conventional existing charging well which is centrally located along the longitudinal portion of the bomb. An energizing means which is adopted to be actuated by slipstream air, is fixed within a charging device which is located within the charging well. The energizing means is designed to pop-up out of the charging device as the bomb is released from the aircraft such that in its pop-up position it receives slipstream air which in turn actuates the device. Means are provided for making electrical contact between the energizing means and the bomb only when the energizing means is in its pop-up position. This device also suffers from the above-described problem. Sabotage on the ground or mechanical defects could result in the bomb being installed on the plane with the charging device in its pop-up position. If this occurs, the fuze could be prematurely charged after the plane takes off, which could lead to premature detonation of the bomb.

SUMMARY OF THE INVENTION

A bomb having an electrical fuze is provided in the present invention. Located within the bomb is a charging device. Located within the charging device is a wind driven energizing means. Means are provided for causing the energizing means to pop-up out of said charging device when the bomb is released from a plane so as to expose the energizing means to the wind. Means are also provided for producing an electrical signal when the energizing means pops-up out of the charging device. The wind driven energizing means supplies power to the fuze through means for supplying power only if it is activated by the wind within a present time of the electrical signal occurring.

The means for producing an electrical signal when the energizing means pops-up out of the charging device comprises a magnet with a coil of wire disposed within the field of the magnet. Means for changing the flux surrounding the magnet is provided to induce an electrical signal in the coil. The electrical signal charges a capacitor. A resistor is in parallel connection with the capacitor. The present time referred to above is determined by the resistor-capacitor time constant.

The energizing means supplies power to the fuze through a silicon controlled rectifier. A first transistor is turned on by the voltage generated by the energizing means. A second transistor is turned on by the first transistor. The second transistor provides a path from the capacitor to the gate of the rectifier. If the energizing means does not supply voltage to the first transistor within the time determined by the resistor-capacitor time constant, the voltage on the capacitor will have bled off, and the silicon controlled rectifier will not fire, and no power will be supplied to the fuze.

OBJECTS OF THE INVENTION

It is an object of this invention to provide means to prevent sabotage of accidental arming of bombs prior to installation on the aircraft.

It is another object of this invention to produce an electrical signal when the energizing means pops-up out of the bomb's charging device.

It is a further object of this invention to provide power generated by the energizing means to the electrical fuze only if the energizing means is actuated by the wind within a preset time of the electrical signal occurring.

DESCRIPTION OF THE PREFERRED EMBODIMENT

Figure 1:
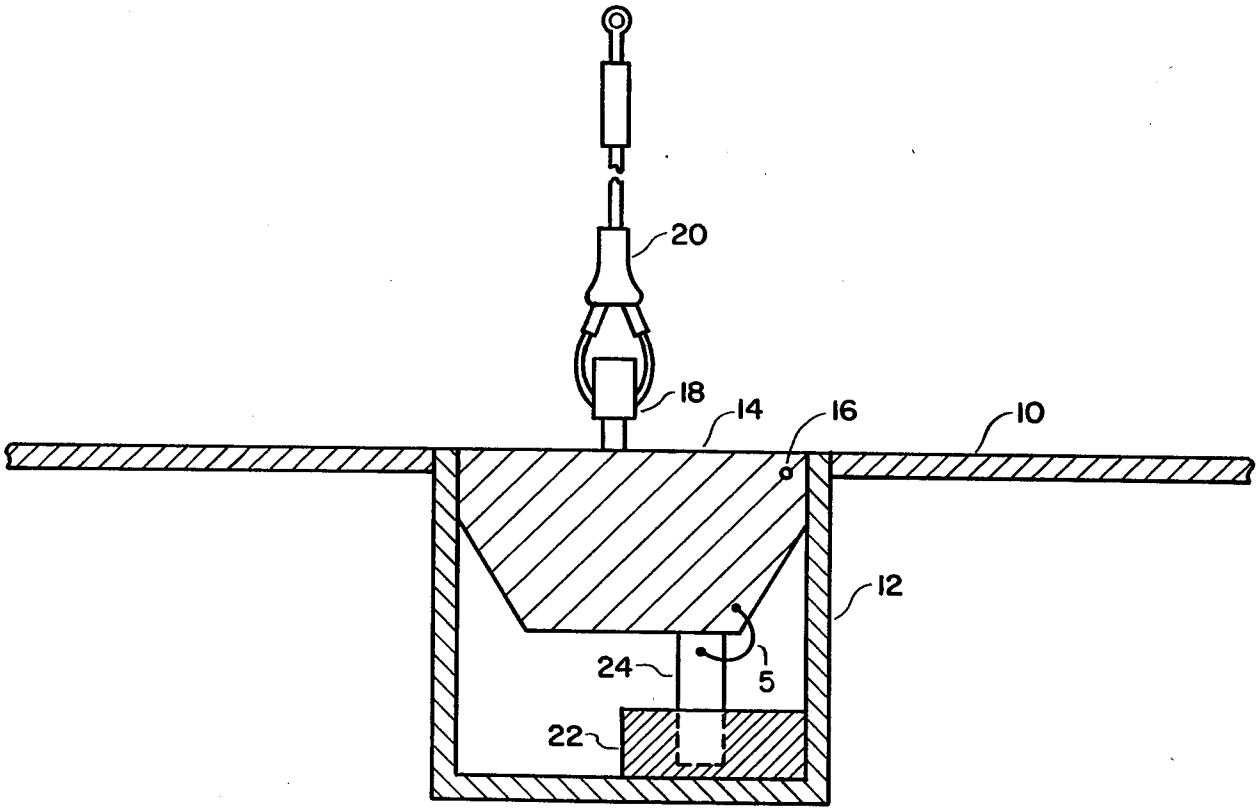
FIG. 1 is a cross sectional view of a bomb having a charging device. The pop-up energizing means is in its retracted position.

Referring now to the figures, FIG. 1 shows a cross section of a bomb casing 10. Mounted within bomb casing 10 is charging device 12. Contained within charging device 12 is pop-up cover 14, which is connected to the charging device 12 by spring loaded hinge 16. Mounted within charging device 12 is magnetic sensor 22 and release pin 24. Release pin 14 is held in place by means of pop-up cover 14. Release pin 24 is connected to pop-up cover 14 by means of cord 5. Eye 18 is attached to pop-up cover 14. Attached to eye 18 is lanyard 20, which is also attached to the aircraft.

Figure 2:
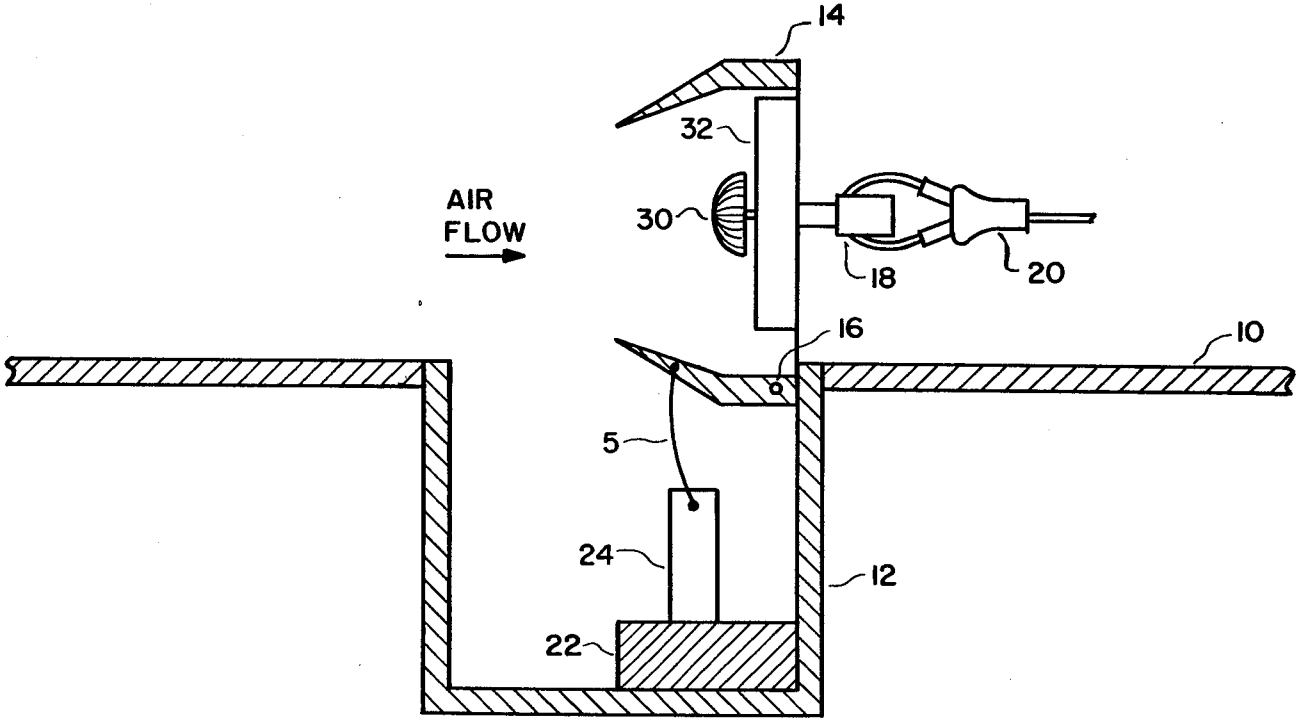
FIG. 2 is a cross sectional view of the bomb of FIG. 1 with the pop-up energizing means in its popped-up position. Elements of FIG. 2 corresponding to those of FIG. 1 are correspondingly numbered.

When the bomb is released from the aircraft, lanyard 20 pulls on eye 18 which in turn pulls on pop-up cover 14. This causes pop-up cover 14 to deploy in its pop-up mode as shown in FIG. 2. Lanyard 20 breaks when 50–100 pounds of force is applied to it. Contained within pop-up cover 14 is the wind driven energizing means. It comprises a multipole alternator 32 driven by an anemometer type vane 30. It is driven by air flowing past the bomb. The alternator is designed such that a magnetic lock of the rotor will prevent rotation of vane 30 until a preselected minimum air velocity is attained due to the slipstream air. Excess air is exhausted to the atmosphere by new means not shown. Alternator 32 supplies electrical power by means of wires not shown.

Referring again to FIG. 2, release pin 24 is shown in its deployed position. Release pin 24 may be pushed out of magnetic sensor means 22 by means of a spring positioned within the sensor, or by a direct mechanical connection with it and cover 14. Any other suitable means may be used to place release pin 24 into its deployed position when cover 14 pops up out of charging device 12. In the preferred embodiment, it is pulled out by means of cord 5.

Figure 3:
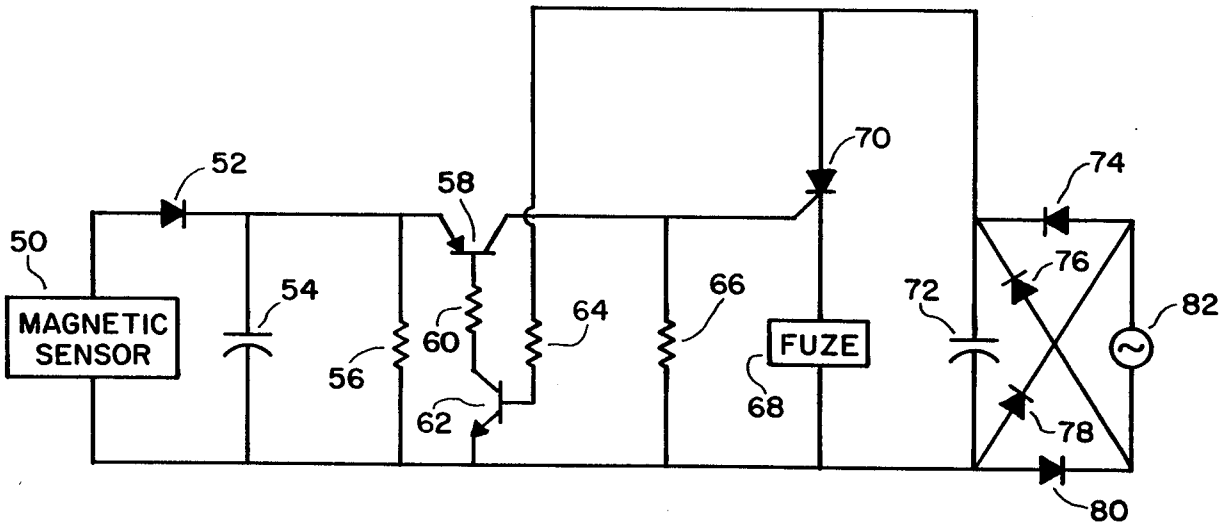
FIG. 3 is a schematic diagram of the circuit of the present invention.

FIG. 3 is a schematic of the circuit of the present invention. Magnetic sensor means 50 produces an electrical signal when the energizing means pops-up out of charging device 12 (FIGS. 1 and 2). This signal is rectified by diode 52, and capacitor 54 is charged by it. Resistor 56 is in parallel connection with capacitor 54. The preset time referred to above is determined by the resistor-capacitor time constant of capacitor 54 in parallel connection with resistor 56.

Alternator 82 (32 in FIG. 2) supplies power to a full wave bridge rectifier comprised of diodes 74, 76, 78, and 80. Capacitor 72 filters the output of the bridge rectifier. The output of the bridge rectifier flows through resistor 64 to the base terminal of npn transistor 62. The emitter of transistor 62 is connected to ground, and the collector of transistor 62 is connected to resistor 60 which is in turn connected to the base of pnp transistor 58. The collector of transistor 58 is connected to the gate of silicon rectifier 70. The emitter of transistor 58 is connected to one side of capacitor 54 - resistor 56 combination. Resistor 66 is connected between the collector of transistor 58 and ground. Alternator 82 and the full bridge rectifier also supply power to the anode of silicon controlled rectifier 70. The cathode of silicon controlled rectifier is connected to fuze 68.

Figure 4:
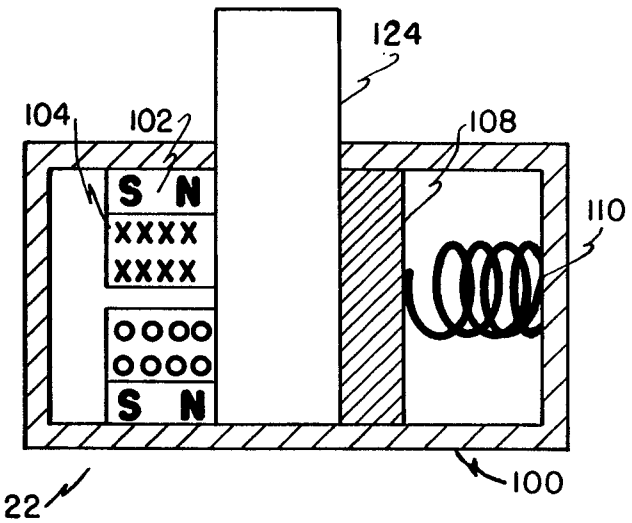
FIG. 4 is a cross sectional view of the magnetic sensor means in its initial position.

An embodiment of the magnetic sensor is shown in FIG. 4. It comprises a ring magnet 102 with a coil of wire disposed within the field of magnet 102. The release pin 24 is shown in its initial position between the magnet 102 and iron armature 108. Armature 108 is spring loaded by spring 110. All of the parts are contained within case 100, with release pin 24 extending through it. The output of coil 104 is connected to the anode of diode 52.

Figure 5:
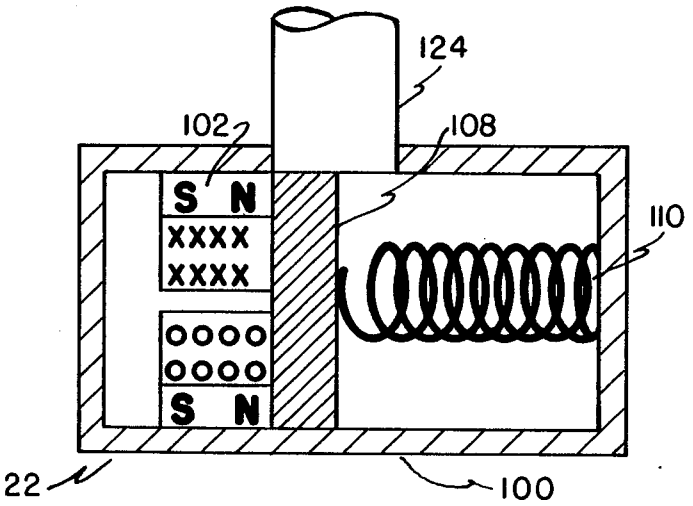
FIG. 5 is a cross sectional view of the magnetic sensor means in its actuated position. Elements of FIG. 5 corresponding to those of FIG. 4 are correspondingly numbered.

FIG. 5 shows what occurs when release pin 24 is pulled out of case 100. Spring 110 pushes iron armature 108 against ring magnet 102. This changes the magnetic flux and a voltage signal is produced in coil 104. This voltage signal is used to charge capacitor 54.

In operation, when the bomb is released from a plane, lanyard 20 pulls pop-up cover 14 up. Pop-up cover 14 in turn pulls release pin 24 out of case 100, which allows iron armature 108 to be pushed against ring magnet 102. A voltage is produced in coil 104, which charges capacitor 54. The capacitor will discharge according to the resistor-capacitor time constant. If capacitor 54 has a value of 0.22 microfarads, and resistor 56 has a value of 20 megohms, then the time constant is 4.4 seconds.

When air flow of sufficient velocity is present, vane 30 of alternator 32 will rotate, and a voltage will be produced. This voltage turns on transistor 62, which in turn turns on transistor 58. Transistor 58 provides a path from capacitor 54 to the gate of silicon controlled rectifier 70. If the voltage from alternator 82 in FIG. 3 comes up within the time set by the resistor-capacitor time constant, it will be supplied to fuze 68 because the charge on capacitor 54 will have fired the gate of silicon controlled rectifier 70. If capacitor 54 has already discharged, silicon controlled rectifier 70 will never fire, and fuze 68 will receive no power.

While the invention has been described with reference to the accompanying drawings, we do not wish to be limited to the details shown therein as obvious modifications may be made by one of ordinary skill in the art.

We claim:

1. An apparatus comprising:

a. a bomb having an electrical fuze;

b. a charging device located within said bomb;

c. wind driven energizing means located within said charging device;

d. means for causing said energizing means to pop-up out of said charging device so as to expose said energizing means to the wind;

e. means for producing a signal when said energizing means pops-up out of said charging device; and f. means for supplying power generated by said energizing means to said fuze only if said energizing means is activated by the wind within a preset time of said signal occurring.

2. The apparatus of claim 1, wherein said means for producing a signal when said energizing means pops-up out of said charging device comprises:

a. a magnet;

b. a coil disposed within the field of said magnet; and c. means for changing the flux surrounding said magnet to thereby induce an electrical signal in said coil.

3. The apparatus of claim 1 further comprising:

a. a resistor; and b. a capacitor in parallel connection with said resistor, wherein said signal changes said capacitor, and said present time is determined by resistor-capacitor time constant.

4. The apparatus of claim 3 wherein said means for supplying power generated by said energizing means is activated by the wind within a preset time of said signal occurring comprises:

a. a silicon controlled rectifier;

b. said energizing means supplies power to said fuze through said silicon controlled rectifier;

c. a first transistor being turned on by the voltage generated by said energizing means;

d. a second transistor being turned on by said first transistor; and e. said second transistor provides a path from said capacitor to the gate of said silicon controlled rectifier.

* * * * *